United States Patent [19]

Izawa et al.

[11] 4,006,517

[45] Feb. 8, 1977

[54] STUFFER BOX CRIMPING APPARATUS

[75] Inventors: Nobuharu Izawa; Yasumasa Nomizo; Kenji Kanda, all of Matsuyama, Japan

[73] Assignee: Teijin Limited, Osaka, Japan

[22] Filed: Feb. 3, 1976

[21] Appl. No.: 654,980

[30] Foreign Application Priority Data

Feb. 10, 1975 Japan ..... 50-16222

[52] U.S. Cl. ..... 28/1.6

[51] Int. Cl.[2] ..... D02G 1/12

[58] Field of Search ..... 28/1.6, 72.14

[56] References Cited

UNITED STATES PATENTS

| | | | |
|---|---|---|---|
| 3,237,270 | 3/1966 | Dennis | 28/1.6 |
| 3,600,776 | 8/1971 | Aoki et al. | 28/1.6 |
| 3,618,183 | 11/1971 | Funk et al. | 28/1.6 |
| 3,633,255 | 1/1972 | Price | 28/1.6 |

*Primary Examiner*—Louis K. Rimrodt
*Attorney, Agent, or Firm*—Burgess Ryan and Wayne

[57] ABSTRACT

A stuffer box crimping apparatus for thermoplastic filamentary tow which comprises a pair of a cylindrical parallel nipping rollers forming a nip therebetween, a stuffer box and a pair of cheek members arranged in contact with outer lateral side surface of the nipping rollers, and which is capable of continuously operating over a long period of time without replacement of the cheek members and is obtained by using high durability cheek members comprising a base layer made of a hard material and a soft surface layer consisting of a soft material and having a thickness of 0.2 mm or less, which soft surface layer is formed at least on a surface portion of the base layer to be brought into contact with the outer lateral side surfaces of the nipping rollers.

17 Claims, 6 Drawing Figures

STUFFER BOX CRIMPING APPARATUS

The present invention relates to a stuffer box crimping apparatus for thermoplastic filamentary tow. More particularly, the instant invention concerns a stuffer box crimping apparatus for thermoplastic filamentary tow, including therein a pair of cheek members having a high durability, said apparatus being capable of working continuously over a long period time of without renewing the cheek member.

In general, a conventional stuffer box crimping apparatus comprises a pair of cooperating cylindrical parallel nipping rollers forming a nip and followed by a stuffer box, and a cheek member located in contact with outer lateral side surfaces of the nipping rollers. The filamentary tow is supplied into the nip of the nipping rollers and fed therethrough into the stuffer box in which the filamentary tow is compressed into a zig-zag configuration. The cheek member is located in contact with the outer lateral side surface of the nipping rollers at the nip of the nipping rollers so as to prevent the lateral egress of the filamentary tow from the nip of the nipping rollers.

Since the cheek member is located in contact with the outer lateral side surface of the nipping rollers, it is important to prevent undesirable abrasion of the outer lateral side surface of the nipping rollers which are expensive. For this purpose, the cheek member of the conventional crimping member is made of a soft material, for example, copper, brass, phosphor bronze and nickel bronze.

However, such soft material has the disadvantage of easy wear by the filamentary two continuously brought into contact with the cheek member during the short time of the crimping operation. Accordingly, the easy wear of the cheek member consisting of the soft material causes undesirable frequent renewals of the cheek member at a short time intervals. For the each such renewal, the operation of the crimping apparatus is undesirably stopped. Such frequent stops result in a low working efficiency of the crimping apparatus.

In order to eliminate the above-mentioned disadvantages of the conventional cheek member, several improvements have been attempted. As a typical example of the attempts, the cheek member is continuously or intermittently rotated while the crimping apparatus is operated, so that the contact portion of the cheek member with the filamentary tow was replaced. The above attempts was effective for improving the durability of the cheek member. However, the improved durability is still not sufficient for the practical use of the cheek member and the essential defect that the contact portion of the cheek member is rapidly worn by the filamentary tow, is not eliminated.

Accordingly, it is desirable to provide the artificial fiber industry with a cheek member which does not wear the outer lateral side surface of the crimping rollers and has a high durability to abrasion with the filamentary tow.

An object of the present invention is to provide a stuffer box crimping apparatus having cheek members with a high durability and being capable of preventing the undesirable wear of the nipping rollers.

The above object has been attained through the study of the inventors. That is, the stuffer box crimping apparatus of the present invention for thermoplastic filamentary tow comprises a pair of a cylindrical parallel nipping rollers forming a nip therebetween and followed by a stuffer box, and a pair of cheek members arranged in contact with outer lateral side surfaces of the nipping rollers at the nip portion of the nipping rollers, said cheek member comprises a base layer consisting of a hard material and a soft surface layer which consists of a soft material and has a thickness of 0.2 mm or less, and said soft surface layer is supported on at least a surface portion of said base layer to be brought into contact with the outer lateral side surfaces of said nipping rollers.

The features and advantages of the present invention are more fully illustrated by the following description with reference to the accompanying drawings, in which.

Figure 1:
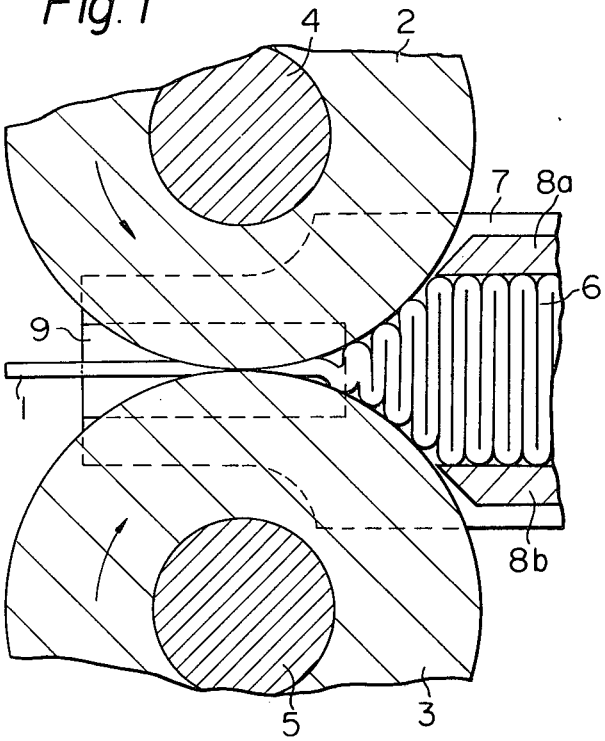
FIG. 1 is an enlarged explanatory partial view of a cross-section of an embodiment of the crimping apparatus of the present invention.

Referring to FIG. 1, a filamentary tow 1 is supplied to a pair of cooperating cylindrical parallel nipping rollers 2 and 3 mounted on rotating shafts 4 and 5, respectively. The nipping rollers 2 and 3 are urged together to form a nip therebetween and rotate in the directions indicated by the arrows in FIG. 1, respectively. The filamentary tow is nipped between the nipping rollers 2 and 3 and conveyed into a stuffer box 6. The stuffer box 6 is defined by a pair of side plates 7 facing each other and a pair of doctor blades **8*a* and 8*b* facing each other. The stuffer box 6 is also provided with a compressing plate (not shown in the drawing) for maintaining the crimped filamentary tow in the stuffer box in a compressed condition. The side plates 7 extend from the stuffer box toward the nipping rollers 2 and 3 so as to cover the outer lateral side surfaces of the nipping rollers 2 and 3. The ends of the doctor blades 8*a* and 8*b* approach the periphery surfaces of the nipping rollers 2 and 3 at close clearance. In order to prevent undesirable lateral egress of the filamentary tow from between the nip of the nipping rollers 2 and 3, a pair of cheek members 9 are located, on the side plates 7, in contact with the outer lateral side surface of the nipping rollers 2 and 3 at the nip portion thereof. In FIG. 1, the cheek member 9** is a quadrilateral plate, particularly, a rectangular plate.

Figure 2:
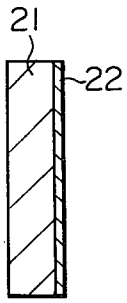
FIG. 2 is a cross-sectional view of an embodiment of a cheek member usable for the present invention.
Figure 3:
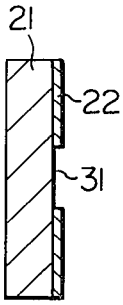
FIG. 3 is a cross-sectional view of another embodiment of the cheek member usable for the present invention.

Referring to FIG. 2, the cheek member 9 consists of a base layer 21 consisting of a hard material and a soft surface layer 22 consisting of a soft material, having a thickness of 0.2 mm or less and supported on the base layer 21. The base layer preferably has a hardness of at least 22Hs, more preferably, at least 30Hs. The soft surface layer has a hardness lower than that of the base layer, preferably, ranging between 10 to 30Hs, more preferably, 10 to 20Hs. The hard material usable for the base layer may be selected from the group consisting of steel, stainless steel, tool steel, alumina, titanium oxide and pottery. The soft material usable for the soft surface layer may be selected from the group consisting of copper, bronze alloys, for example phosphor bronze and nickel bronze, brass and organic polymeric materials, for example, nylon 6, nylon 66 and polyesters. It is preferable that a difference in hardness between the hard material and the soft material is 5HS or more, preferably about 10HS. The soft surface layer has a thickness of 0.2 mm or less, preferably, 0.01 to 0.1 mm, and may be supported only on a surface portion of the base layer to be brought into contact with the outer lateral side surfaces of the nipping rollers. Otherwise, the soft surface layer may be formed on whole surface of the base layer, as indicated in FIG. 2. When the crimping apparatus of FIG. 1, having the cheek member of FIG. 2, is continuously operated over a long time, the soft surface layer of the cheek member is rubbed by a side edge of the filamentary tow brought into contact with the cheek member. Especially, the soft surface layer is strongly rubbed by the side edge of the filamentary tow passing and just after passing through the nip of the nipping rollers. Since the soft surface layer made of a soft material has a relatively low resistance to abrasion, the rubbed portion of the soft surface layer is easily abraded from the base layer within a short time so as to form a groove in the soft surface layer. That is, by the abrasion, the cross-sectional profile of the cheek member of FIG. 2 is converted into that of FIG. 3 in which a groove 41 is formed in the surface layer 21. The bottom of the groove 31 is formed by a portion of the base layer exposed to the atmosphere. Accordingly, after the rubbed portion of the soft surface layer is removed the side edge of the filamentary tow is brought into direct contact with the exposed surface portion of the base layer. However, since the base layer made of the hard material has a high resistance to abrasion, the cheek member having the configuration of FIG. 3 has a high durability. In order to smoothly slide the side edge of the filamentary tow along the exposed surface of the base layer, it is preferable that the surface of the base layer has a surface roughness of 0.8-S or less, more preferably, 0.5-S or less determined in accordance with the method of JIS B-0601. Also, it is necessary that the groove 31 has a depth of 0.2 mm or less, because a groove with a depth deeper than 0.2 mm results in undesirable breakage of the individual filaments sliding along the groove.

The groove for receiving the side edge of the filament tow may be preliminarily formed in the cheek member. In this type of cheek member, the portion of the base layer with which the side edge of the filamentary tow is brought into contact, is not coated with the soft surface layer, in other words, is exposed to the atmosphere.

Figure 5:
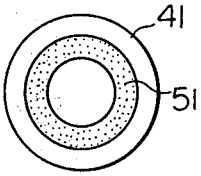
FIGS. 5 and 6 are a plane view of another embodiment of the cheek member usable for the present invention, respectively.
Figure 4:
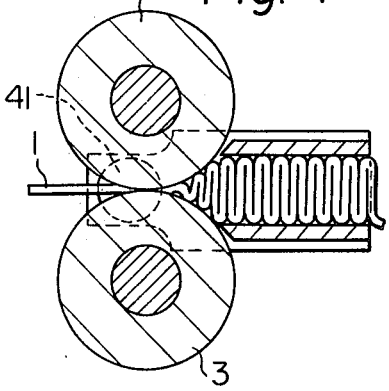
FIG. 4 is an explanatory cross-sectional view of another embodiment of the crimping apparatus of the present invention.

A crimping apparatus having another type of the cheek member is shown in FIG. 4. In the drawing, the cheek member 41 is a disk-shaped plate comprising a base layer and a soft surface formed on the base layer. While the crimping apparatus is continuously operated for a long time, disk-shaped cheek member 41 may be continuously rotated slowly about the rotation axis thereof. In this case, the portion of the soft surface layer rubbed by the side edge of the filamentary tow is removed and an annular groove 51 is formed in the cheek member 41 as indicated in FIG. 5. The annular groove 51 has a bottom defined by the base layer having a high resistance to abrasion. This configuration of the cheek member has a high durability due to the high abrasive resistance of the base layer. The annular groove 51 in FIG. 5 may be preliminarily formed in the disk-shaped cheek member so that the bottom surface of the annular groove made of the hard base layer is directly exposed to the atmosphere.

Figure 6:
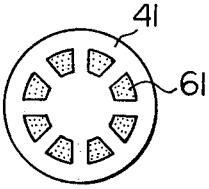

In the embodiment of the crimping apparatus of FIG. 4, the disk-shaped cheek member may be intermittently rotated at a predetermined angle while the crimping apparatus is operated. If this is the case, the soft surface layer is partially abraded so as to form a plurality of cavities 61 radially arranged around the axis of the disk-shaped cheek member 41, as indicated in FIG. 6.

In another embodiment of the disk-shaped cheek member, a plurality of cavities having a bottom defined by the hard base layer may be preliminarily radially formed in the soft surface layer about the rotation axis of the disk-shaped cheek member.

In any of the above-mentioned types of the cheek members, the soft surface layer may be formed on both the upper and lower surfaces of the base layer so that both surfaces of the cheek member can be utilized for the crimping operation and so that the cheek member has a durability of twice that of a cheek member having a single soft surface layer.

In the crimping apparatus of the present invention, since a portion of the cheek member which is in contact with the outer lateral side surfaces of the nipping rollers are coated with the soft material, the outer lateral side surfaces can be prevented from abrasion or wear during the operation period of the crimping apparatus.

The soft surface layer may be applied onto the base layer by any of the conventional methods, for example, plating methods, bonding methods and metal spraying method.

In a preferable embodiment, the soft surface layer consists of a soft metallic material plated on the base layer.

The crimping apparatus of the present invention can be applied to any types of thermoplastic filamentary tows, for example, those consisting of cellulose diacetate, cellulose triacetate, polyesters, such as polyethylene terephthalate, polyamides such as nylon 6, nylon 66, nylon 12 and nylon 610, polyolefins such as polyethylene and polypropylene, polyacrylonitrile, polyvinyl chloride and acrylonitrile-vinyl acetate copolymers.

The present invention will be further illustrated by the following examples, which are not intended to limit the scope of the present invention.

EXAMPLE

A filamentary low having a denier of 400,000 and consisting of individual filaments each having a denier of 1.5 and consisting of polyethylene terephthalate having an intrinsic viscosity of 0.65, which has been determined in O-chlorophenol solution at a temperature of 35° C, was crimped by feeding it into a crimping apparatus as shown in FIG. 1 at a feed rate of 100 m/min. The crimping apparatus was provided with a pair of rectangular cheek members which consist of a base layer made of carbon steel having a hardness of 30Hs, a thickness of 4.0 mm and provided with a surface having a surface roughness of 0.3–S, and; a soft surface layer having a thickness of 0.02 mm and consisting of copper having a hardness of 15Hs. The surface layer was formed by plating copper on the base layer. The crimping apparatus could be operated continuously for 7 hours without replacement of the cheek members. That is, the cheek member had a durability of 7 hours. The durability used herein refers to a length of time from the start of the crimping operation to the end thereof at which the individual filaments brought into contact with the cheek member are broken at a breakage number of 3/inch.

COMPARISON EXAMPLE 1

The same crimping operations as in the above Example were carried out using a pair of rectangular cheek members consisting of a phosphor bronze having a hardness of 21Hs. The durability of the cheek members were 0.5 hours.

COMPARISON EXAMPLE 2

The same crimping operations as in the Example were effected, except that the copper soft surface layer was formed with a thickness of 0.5 mm by plating copper on the base layer. After 0.5 hours from the start of the crimping operations, it was observed that the individual filaments in the filamentary tow were broken at a breakage number of more than 3/inch. That is, the durability of the cheek member was about 0.5 hours.

What we claim is:

1. A stuffer box crimping apparatus for a thermoplastic filamentary tow comprising a pair of a cylindrical parallel nipping rollers forming a nip therebetween, a stuffer box adjacent said nipping rollers and receiving said tow from said nip, and a pair of cheek members arranged in contact with outer lateral side surfaces of said nipping rollers at the nip portion of said nipping rollers, said cheek member comprising a base layer consisting of a hard material and a soft surface layer which consists of soft material and has a thickness of 0.2mm or less, said soft surface layer being supported on at least a surface portion of said base layer in contact with the outer lateral side surfaces of said nipping rollers, said surface portion of said base layer being substantially parallel to said outer lateral side surfaces of said nipping rollers.

2. An apparatus as claimed in claim 1, wherein said cheek member is in a quadrilateral shape.

3. An apparatus as claimed in claim 1, wherein said cheek member is in a disk-shape.

4. An apparatus as claimed in claim 1, wherein said soft surface layer consists of a soft metallic material plated on said base layer.

5. An apparatus as claimed in claim 3, wherein said disk-shaped cheek member is continuously rotatable.

6. An apparatus as claimed in claim 3, wherein said disk-shaped cheek member is intermittently rotatable through a predetermined angle.

7. An apparatus as claimed in claim 1, wherein said base layer of said cheek member has a hardness of at least 22Hs.

8. An apparatus as claimed in claim 7, wherein said hardness of said base layer is at least 30Hs.

9. An apparatus as claimed in claim 1, wherein said surface layer of said cheek member has a hardness of 10 to 30Hs.

10. An apparatus as claimed in claim 9, wherein said hardness of said soft surface layer is between 10 to 20Hs.

11. An apparatus as claimed in claim 1, wherein said hard material is selected from the group consisting of steel, stainless steel, tool steel, alumina, titanium oxide and pottery.

12. An apparatus as claimed in claim 1, wherein said soft material is selected from the group consisting of copper, bronze alloys brass and organic polymeric materials.

13. An apparatus as claimed in claim 12, wherein said bronze alloy is either phosphor bronze or nickel bronze.

14. An apparatus as claimed in claim 12, wherein said organic polymeric material is selected from the group consisting of nylon 6, nylon 66 and polyesters.

15. An apparatus as claimed in claim 1, wherein said thickness of said surface layer falls in a range of 0.01 to 0.1 mm.

16. An apparatus as claimed in claim 1, wherein the surface of said base layer has a surface roughness of 0.8-S or less.

17. An apparatus as claimed in claim 16, wherein said surface roughness is 0.5-S or less.

* * * * *